US006004360A

United States Patent [19]

Andersson

[11] Patent Number: 6,004,360

[45] Date of Patent: Dec. 21, 1999

[54] PROCESS FOR PREPARING A FUEL FROM TALL-OIL SOFT SOAP

[75] Inventor: Susanne Andersson, Lidingö , Sweden

[73] Assignee: AGA AB, Lidingo, Sweden

[21] Appl. No.: 08/894,605

[22] PCT Filed: Feb. 7, 1996

[86] PCT No.: PCT/SE96/00145

§ 371 Date: Nov. 24, 1997

§ 102(e) Date: Nov. 24, 1997

[87] PCT Pub. No.: WO96/24651

PCT Pub. Date: Aug. 15, 1996

[30] Foreign Application Priority Data

Aug. 2, 1995 [SE] Sweden ..... 9500451

[51] Int. Cl.[6] ..... C10L 1/02

[52] U.S. Cl. ..... 44/306

[58] Field of Search ..... 44/306

[56] References Cited

U.S. PATENT DOCUMENTS

| | | | |
|---|---|---|---|
| 3,901,869 | 8/1975 | Bills | 260/97.5 |
| 4,075,188 | 2/1978 | Vardell, Jr. | 260/97.7 |
| 5,283,319 | 2/1994 | Huibers et al. | 530/209 |
| 5,286,845 | 2/1994 | Huibers et al. | 530/208 |

FOREIGN PATENT DOCUMENTS

83/00344 2/1983 WIPO .

*Primary Examiner*—Jacqueline V. Howard
*Assistant Examiner*—Cephia D. Toomer
*Attorney, Agent, or Firm*—Pearne, Gordon, McCoy & Granger LLP

[57] ABSTRACT

A method for preparing fuel from tall-oil soap. The tall-oil soap is mixed with diesel oil. The tall-oil soap and the diesel oil are then reacted with carbon dioxide, thereby forming a reaction product and a mixture of diesel oil, tall oil and tall-oil soap. The mixture is separated from the reaction product and recovered. The mixture may then be burned as a fuel.

5 Claims, No Drawings

PROCESS FOR PREPARING A FUEL FROM TALL-OIL SOFT SOAP

This application is a 371 of PCT/SE96/00145, filed Feb. 7, 1996.

BACKGROUND OF THE INVENTION

The present invention relates to a method of producing fuel from tall-oil soap by treating the soap with carbon dioxide. Tall-oil soap is a by-product of sulphate pulp manufacturing processes. The soap can be separated out from black liquor when concentrating the liquor into heavy black liquor. The tall-oil soap obtained has a pH of about 12 and is normally acidified with sulphuric acid to convert the soap to tall oil. A process of this kind is, in principle, carried out in all sulphate pulp mills. The tall oil obtained can be used as a crude product in the preparation of different chemicals or as fuel.

One drawback with this process is that relatively large volumes of sulphuric acid are required. The delivery of sulphur to the system makes it difficult to achieve a closed process in the mill while avoiding environmentally harmful emissions.

It has been proposed to treat tall-oil soap with carbon dioxide, with the intention of eliminating the use of sulphuric acid or reducing the amounts in which it is used. The proposed process uses inorganic carbonic acid which is generated by the reversible reaction between carbon dioxide and water:

$$CO_2+H_2O \leftrightarrows H_2CO_3$$

The resultant carbonic acid reacts with the tall-oil soap in accordance with the following reactions:

$$RCOONa+H_2CO_3 \leftrightarrows RCOOH+NaHCO_3$$

However, only about half of the soap is converted to tall oil in these reactions.

Because the earlier processes that use carbon dioxide have been intended mainly to produce the purest possible tall oil, so as to enable the oil to be used in the preparation of different chemicals, the carbon dioxide treatment stage is followed by a sulphuric acid treatment stage. Although this process results in a reduction of the sulphuric acid otherwise required, it does not eliminate the use of sulphuric acid completely. An alternative solution proposes the onerous repetition of the carbon dioxide treatment in several treatment steps.

The present invention is based on the realization that tall-oil soap can be treated with carbon dioxide to obtain a fuel which contains tall oil that does not require the same degree of purity as tall oil intended for some other use. The inventive process affords the important advantage of enabling tall-oil soap to be used as fuel without the addition of sulphur.

SUMMARY OF THE INVENTION

It therefor would be desirable, and is an advantage of the present invention, to provide a method for using tall-oil soap to generate heat. In accordance with the method, the tall-oil soap is mixed with diesel oil. The tall-oil soap and the diesel oil are then reacted with carbon dioxide, thereby forming a reaction product and a mixture of diesel oil, tall oil and tall-oil soap. The mixture is separated from the reaction product and recovered. The mixture is then burned.

DETAILED DESCRIPTION OF THE PREFERRED EMBODIMENTS

In a preferred embodiment of the invention, the reaction with carbon dioxide is effected in one single method step, although it may be effected in two or more steps.

In order to obtain an effective reaction between tall-oil soap and carbon dioxide, the soap is preferably diluted with liquid prior to being treated with carbon dioxide. In this regard, it is preferred that the soap is fit mixed with an organic solvent. This enables a large part of the soap to be converted to tall oil.

The solvent used will conveniently have a high calorific value, because the end product will then have a higher fuel value.

The solvent used will preferably be combustible or fuel oil such as diesel oil, for instance.

The process can also be carried out by mixing tall-oil soap with water prior to reacting the soap with carbon dioxide. The amount of water used will preferably correspond to 0.5–3 times the amount of soap present, on a weight basis.

According to the preferred embodiment of the present invention, tall-oil soap is mixed with a water-immiscible organic solvent in the form of fuel oil or combustible oil. This produces a heterogenous system in which the free fatty acids are more soluble in the added solvent than the tall-oil soap. This results in more extensive acidification of the tall-oil soap by the added carbon dioxide than would otherwise have been possible.

The solvent is added to the tall-oil soap in a quantity such that the resulting mixture will contain 30–70 percent by weight, preferably 50 percent by weight, solvent.

The manner in which the carbon dioxide is delivered to the soap will depend on the form in which the carbon dioxide is present, i.e. whether the carbon dioxide is in a solid state, a liquid state or a gaseous state.

Tests have been carried out in which gaseous carbon dioxide was delivered under a given overpressure to a reactor equipped with an agitator. Good results were obtained when delivering the carbon dioxide at a temperature of 40° C. and at an overpressure of 5–6 bars, with a reactor treatment-time of ½–1 hour.

In these tests, the tall-oil soap was first mixed with diesel oil in essentially similar volumes. Upon completion of the reaction with carbon dioxide, a residual solution was separated from the reaction product whereupon the remainder was used as fuel. This fuel was found to have a good calorific value and comprised tall oil, diesel oil and tall-oil soap residues.

Although a solvent, conveniently oil, is preferably used in the inventive process, the solvent can be replaced with water. In this case, the tall-oil soap is, suitably mixed with at least equal parts of water prior to being treated with carbon dioxide. The tall-oil soap may also be mixed with a combination of solvent and water.

An important feature of the different embodiments of the invention is that tall-oil soap produced in the manufacture of pulp can be used in an environmentally-friendly and cost-effective manner, by converting the soap into a high calorific fuel without the use of sulphur. It is preferred from an economic and time aspect that this conversion is effected in one single step.

It will be understood that the inventive process can be modified within the scope of the following claims in several respects with regard to process parameters and process conditions.

I claim:

1. A method of producing fuel from tall-oil soap, said method comprising the steps of:

mixing the tall-oil soap with diesel oil;

reacting the tall-oil soap and diesel oil with carbon dioxide, thereby forming a reaction product and a mixture of diesel oil, tall oil and tall-oil soap;

separating the mixture from the reaction product; and recovering the mixture for use as a fuel.

2. A method according to claim 1, wherein the reaction of the tall-oil soap with carbon dioxide is performed in one single step.

3. A method according to claim 1, wherein the diesel oil is mixed with the soap in a quantity such that the mixture will contain 30–70 percent by weight diesel oil.

4. A method according to claim 1, comprising the further step of mixing the soap with water in addition to the diesel fuel, prior to reacting the soap with carbon dioxide.

5. A method according to claim 3, wherein the diesel oil is mixed with the soap in a quantity such that the mixture will contain 50 percent by weight diesel oil.

* * * * *

UNITED STATES PATENT AND TRADEMARK OFFICE

CERTIFICATE OF CORRECTION

PATENT NO. : 6,004,360

DATED : December 21, 1999

INVENTOR(S) : Andersson

It is certified that error appears in the above-indentified patent and that said Letters Patent is hereby corrected as shown below:

On the Title Page, Section [54], delete "TALL-OIL" and insert --TALL--.

Column 2, Line 4, delete "fit" and insert --first--.

Column 2, Line 46, delete "is," and insert --is--.

Signed and Sealed this

Seventeenth Day of October, 2000

*Attest:*

Q. TODD DICKINSON

*Attesting Officer*

*Director of Patents and Trademarks*